United States Patent [19]

Brown, Jr.

[11] Patent Number: 4,780,068

[45] Date of Patent: Oct. 25, 1988

[54] FOLDED CHANNEL RADIAL PUMP

[75] Inventor: Arthur K. Brown, Jr., South Bend, Ind.

[73] Assignee: Allied-Signal, Inc., Morristown, N.J.

[21] Appl. No.: 61,743

[22] Filed: Jun. 15, 1987

[51] Int. Cl.[4] ..... F04B 29/00

[52] U.S. Cl. ..... 417/462; 417/426

[58] Field of Search ..... 417/460, 462, 463, 500, 417/439, 426

[56] References Cited

U.S. PATENT DOCUMENTS

| | | | |
|---|---|---|---|
| Re. 27,563 | 1/1973 | Roosa | 417/462 |
| 1,152,453 | 9/1915 | Thune | 417/463 |
| 1,976,642 | 10/1934 | Walker | 417/462 |
| 2,025,771 | 12/1935 | Purvis | 417/462 |
| 2,079,119 | 5/1937 | Hillis | 417/462 |
| 3,056,356 | 10/1962 | Piper | 417/462 |
| 3,307,483 | 3/1967 | von Plato | 417/415 |
| 3,809,506 | 5/1974 | Maclosky | 417/439 |
| 4,153,391 | 5/1979 | Hartley | 417/271 |

FOREIGN PATENT DOCUMENTS

| | | | |
|---|---|---|---|
| 874538 | 3/1952 | Fed. Rep. of Germany | 417/462 |
| 684901 | 7/1930 | France . | |
| 1519042 | 3/1968 | France . | |
| 2503272 | 10/1982 | France . | |
| 48202 | 2/1982 | Japan | 417/462 |
| 60243 | 12/1986 | PCT Int'l Appl. | 417/500 |
| 157408 | 7/1949 | Sweden | 417/462 |
| 599466 | 5/1978 | Switzerland . | |
| 237487 | 11/1969 | U.S.S.R. | 417/462 |
| 2099521A | 12/1982 | United Kingdom | 417/462 |

OTHER PUBLICATIONS

Abstract of Japan—Japanese 57-171085—vol. 7, No. 12 (M-186) [1157]—Jan. 19, 1983.

Abstract of Japan—Japanese 61-123771—vol. 10, No. 325 (M-529) [2371]—Oct. 25, 1967.

*Primary Examiner*—William L. Freeh

*Attorney, Agent, or Firm*—Larry J. Palguta; Ken C. Decker

[57] ABSTRACT

The folded channel radial pump assembly (10) comprises a housing (12) having therein a stepped diameter bore (14) receiving a rotor (30). The rotor (30) is attached by way of a flexible coupling (50) with the output shaft (61) of an electric motor (60) attached to the housing (12). The rotor (30) includes one or more intake (26, 36) and exhaust (28, 38) ports, the ports (26, 28, 36, 38) being radially aligned and communicating with the stepped bore (14). The rotor (30) includes one or more pairs of radial openings (70, 72; 170, 172) disposed substantially parallel to one another and each pair connected by way of an axial passageway (74; 174), one radial opening (70, 170) of the pair being aligned axially with the respective set of intake (26, 36) and exhaust (28, 38) ports and the other radial opening (72, 172) having therein a resilient mechanism (77, 177) biasing a piston (76, 176) and follower mechanism (75, 175) outwardly into engagement with an eccentric diameter section (24, 124) of the stepped bore (14). Rotation of the rotor (30) by the motor (60) causes the follower mechanism (75, 175) and piston (76, 176) to reciprocate within the other radial opening (72, 172) and effect the movement of fluid between the intake (26, 36) and exhaust (28, 38) ports.

11 Claims, 1 Drawing Sheet

FOLDED CHANNEL RADIAL PUMP

This invention relates generally to a pump assembly, in particular a rotary pump assembly that may be used in a vehicle anti-skid system.

Vehicle anti-skid systems utilize an incompressible fluid for actuation and deactuation of the brakes of the vehicle. The incompressible fluid is maintained under pressure and then modulated by appropriate mechanisms in order to modulate braking according to road conditions. The incompressible fluid is usually maintained under pressure by means of a pump disposed within the anti-skid system. It is highly desirable to provide a very compact, quiet, and low-cost pump which provides one or more separate pumping sections powered by a single electric motor. It is important that the pump operate efficiently and quietly, and require as little space as possible.

The present invention is a pump assembly, comprising a housing having a stepped bore disposed therein, radial apertures comprising intake and exhaust ports communicating withthe stepped bore, a rotor disposed within said bore, the rotor having a pair of radial openings disposed substantially parallel to one another and connected by an axial passageway, one of said radial openings aligned with said intake and exhaust ports, the other of said radial openings having therein a piston biased by resilient means against a follower mechanism, the other radial opening aligned with an eccentric diameter section of the stepped bore, so that during rotation of said rotor the follower mechanism is biased by the resilient means and piston into engagement with the eccentric diameter section to effect reciprocating movement of the piston within the other radial opening.

One way of carrying out the invention is described in detail below with reference to the drawings, in which.

Figure 1:
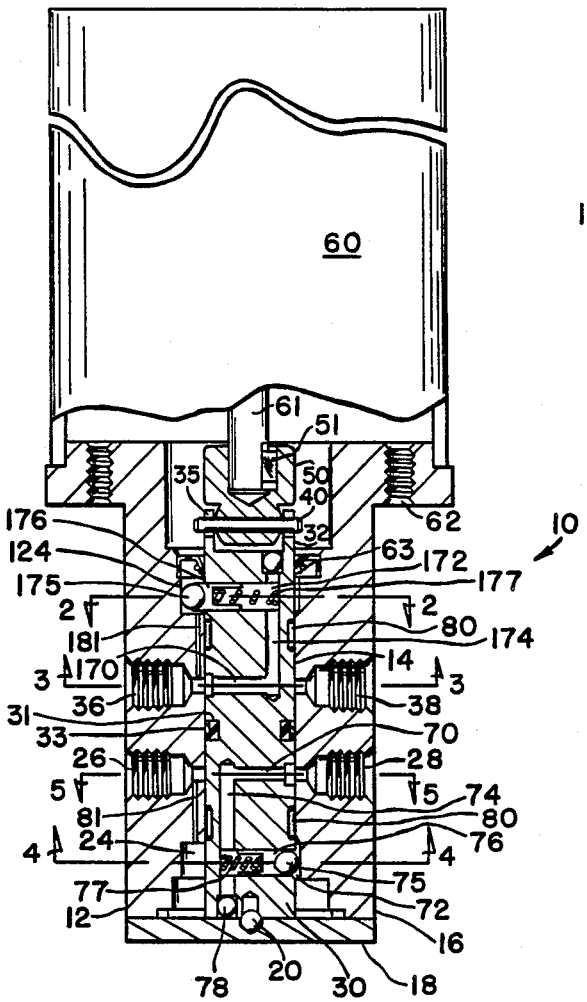
FIG. 1 illustrates a partial section view of the pump assembly and motor mechanism.

The pump assembly is designated generally by reference numeral 10 in FIG. 1. The pump assembly includes a housing 12 having therein a stepped bore 14 extending longitudinally through the housing. One end 16 of housing 12 is enclosed by a cap 18 having a ball bearing member 20 received within a correspondingly shaped opening in the end of rotor 30. Rotor 30 is journalled within the stepped bore by means of needle bearings 80. Housing 12 includes intake ports 26, 36 and exhaust ports 28, and 38. The stepped bore includes two eccentric diameter sections 24 and 124. Rotor 30 is connected at its other end with a pin 40 received rotatably in a flexible coupling 50. Rotor end 32 includes a pair of radial slots 35 which receive the pin 40. Flexible coupling 50 is attached by means of key 51 to motor output shaft 61. An electric motor 60 is attached by means of bolts 62 to housing 12. A fluid seal 63 is disposed about rotor end 32 in order to prevent fluid from leaking out of stepped bore 14.

The rotor 30 includes a radial opening 70 aligned substantially parallel to a second radial opening 72, the radial openings connected by means of an axial passageway 74. The radial openings 70 and 72, through their connection by axial passageway 74, are "folded over" so that they are substantially parallel to one another and in angular alignment with one another relative to the circumference of the rotor. Radial opening 70 is in axial alignment with intake port 26 and exhaust port 28, while radial opening 72 is in axial alignment with eccentric diameter section 24 of stepped bore 14. Radial opening 72 has disposed therein a follower mechanism comprising a ball 75, a piston 76, and resilient spring 77. The spring 77 biases ball 75 into engagement with eccentric diameter section 24. Axial passageway 74 is provided by drilling a hole axially in rotor 30, and the open end of the hole is plugged by the ball valve 78. Eccentric diameter section 24 is connected with intake port 26 by means of the small passageway 81. Rotor 30 has disposed within groove 31 a seal 33 which sealingly divides one pumping section of the pump assembly from another pumping section disposed adjacent rotor end 32.

The pumping section adjacent rotor end 32 is identical to the pumping section described above, and comprises a radial opening 170 disposed substantially parallel to a second radial opening 172 and connected by means of an axial passageway 174. A follower mechanism or ball 175 is received by a piston 176 biased by a resilient spring 177, all being located within the second radial opening 172. An eccentric diameter section 124 causes ball 175 and piston 176 to reciprocate within opening 172. A small passageway or bleed opening 181 connects radial opening 172 with intake port 36.

Figure 2:
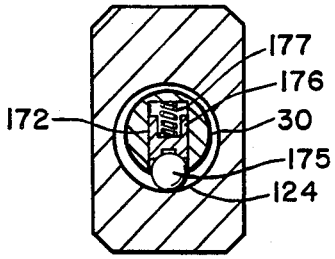
FIG. 2 is a section view taken along view line of 2—2 of FIG. 1.
Figure 3:
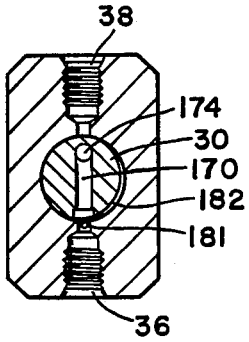
FIG. 3 is a section view taken along view line 3—3 of FIG. 1.
Figure 4:
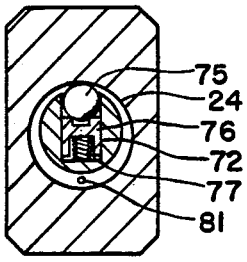
FIG. 4 is a section view taken along view line 4—4 of FIG. 1.

When electric motor 60 rotates rotor 30, the follower mechanisms or balls 75 and 175 follow the diameter of eccentric diameter sections 24, 124 to cause the respective balls and pistons to reciprocate within the associated radial openings. Thus, when radial openings 70 and 170 are in alignment with the respective intake ports 26, 36, as illustrated in FIG. 3 where radial opening 170 is in circumferential alignment with intake port 36, the ball 175 extends out of radial opening 172 (see FIG. 2) so that incompressible fluid is drawn into intake port 36, radial opening 170, axial passageway 174, adn radial opening 172. As rotor 30 rotates, ball 175 and piston 176 are biased by eccentric diameter section 124 back into radial opening 172 so that when radial opening 170 is in angular alignment with exhaust port 38, ball 175 and piston 176 displaces the incompessible fluid in opening 172, passageway 174, and opening 170 out of exhaust port 38. This pumping function is shown in FIGS. 4 and 5 which illustrates ball 75 and piston 76 displaced inwardly of radial opening 72 by means of eccentric diameter section 24 so that the incompressible fluid in radial opening 72, axial passageway 74, and radial opening 70 is displaced through exhaust port 28.

Figure 5:
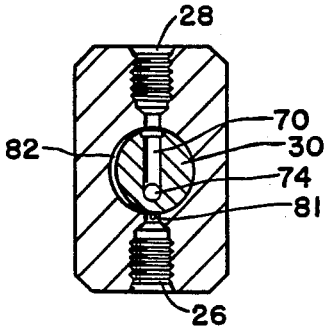
FIG. 5 is a section view taken along view line 5—5 of FIG. 1.

FIGS. 3 and 5 illustrate partial circumferential grooves 182 and 82 which permit the incompressible fluid to begin to enter the interior of rotor 30 prior to the circumferential or angular alignment of radial openings 170 and 70 with the respective intake and exhaust ports. This eliminates fully open and fully closed positions for the ports so that the fluid may flow easily and, most importantly, quietly through the pump. The bleed holes 81 and 181 are provided on the low pressure sides of the pumps so that incompressible fluid that leaks from the rotor or by a pumping piston is displaced back to the intake side of the respective pump. It should be noted that the two pumping mechanisms comprising the radial openings 70, 170, 72, 172, passageways 74, 174, balls 75, 175, pistons 76, 176, and resilient springs 77, 177 are disposed approximately 180° out to phase with one another in order to minimize pumping torque requirements. However, the radial openings and passageways may be aligned angularly with one another.

The present invention provides a pump assembly that is small, very compact, and has a low cost. The pump may operate quietly and provide the necessary pumping function required for a split channel anti-skid system. The universal type of coupling between motor output shaft 61 and rotor 32 eliminates any torque problems caused by a slight variation in alignment therebetween.

Various modifications of the above-described embodiment of the invention will be apparent to those skilled in the art. It is to be understood that such modifications can be made without departing from the scope of the invention. Other provisions of the invention or variations will become apparent to those skilled in the art and will suggest themselves from the specific applications of the invention. It is intended that such variations and revisions of the invention, as are to be expected on the part of those skilled in the art, to suit individual design preference and which incorporate the herein disclosed principles, will be included within the scope of the following claims as equivalents thereof.

I claim:

1. A pump assembly, comprising a housing having a stepped bore disposed therein, radial apertures comprising intake and exhaust ports communicating with the stepped bore, a rotor disposed within said bore, the rotor having a pair of radial openings disposed substantially parallel to one another and connected by an axial passageway, one of said radial opening aligned with said intake and exhaust ports, the other of said radial openings having therein a piston biased by resilient means against a follower mechanism, the other radial opening aligned with an eccentric diameter section of the stepped bore so that during rotation of said rotor the follower mechanism is biased by the resilient means and piston into engagement with the eccentric diameter section to effect reciprocating movement of the piston within the other radial opening and movement of fluid from the intake port to the exhaust port, the housing including a longitudinal passageway communicating the eccentric diameter section with the intake port, the rotor including a circumferential groove extending partially about the circumference thereof, the groove axially aligned with the intake and exhaust ports and communicating with the one radial opening, the pump housing connected with a motor, an output shaft of the motor connected with the rotor, the output shaft and rotor connected by a flexible coupling, and the output shaft and coupling connected by means of a key.

2. The pump assembly in accordance with claim 1, wherein the follower mechanism comprises a ball.

3. The pump assembly in accordance with claim 1, wherein the rotor has an end opening receiving therein the coupling, the rotor including a pair of radial slots disposed opposite one another and the slots receiving therein a radially extending pin of the coupling.

4. The pump assembly in accordance with claim 3, wherein the housing includes a ball bearing received within an opening at an end of said rotor.

5. A pump assembly, comprising a housing having a stepped bore disposed therein, radial apertures comprising intake and exhaust ports communicating with the stepped bore, a rotor disposed within said bore, the rotor having a pair of radial openings disposed substantially parallel to one another and connected by an axial passageway, one of said radial openings aligned with said intake and exhaust ports, the other of said radial openings having therein a piston biased by resilient means against a follower mechanism, the other radial opening aligned with an eccentric diameter section of the stepped bore so that during rotation of said rotor the follower mechanism is biased by the resilient means and piston into engagement with the eccentric diameter section to effect reciprocating movement of the piston within the other radial opening and movement of fluid from the intake port to the exhaust port, the housing including a longitudinal passageway communicating the eccentric diameter section with the intake port, the rotor including a circumferential groove extending partially about the circumference thereof, the groove axially aligned with the intake and exhaust ports and communicating with the one radial opening, the pump assembly comprises a pair of intake ports, a pair of exhaust ports, two pairs of radial openings connected by respective axial passageways, a second follower mechanism, piston and resilient means, and the rotor including sealing means disposed axially between the intake ports in order to effect a fluid seal therebetween.

6. The pump assembly in accordance with claim 5, wherein the pairs of radial openings are substantially angularly aligned with one another in the rotor.

7. The pump assembly in accordance with claim 5, wherein the pairs of radial openings and associated axial passageways are disposed angularly approximately 180° from one another within the rotor.

8. A pump assembly, comprising a housing having a stepped bore disposed therein, radial apertures comprising intake and exhaust ports communicating with the stepped bore, a rotor disposed within said bore, characterized in that the rotor has a pair of radial openings disposed substantially parallel to one another and connected by an axial passageway, one of said radial openings aligned with said intake and exhaust ports, the other of said radial openings having therein a piston biased by resilient means against a follower mechanism, the other radial opening communicating with an eccentric diameter section of the stepped bore so that during rotation of said rotor the follower mechanism is biased by the resilient means and piston into engagement with the eccentric diameter section to effect reciprocating movement of the piston within the other radial opening, the housing including a longitudinal passageway communicating the eccentric diameter section with the intake port, the rotor including a circumferential groove extending partially about the circumference thereof, the groove axially aligned with the intake and exhaust ports and communicating with the one radial opening, the pump housing connected with motor means and an output shaft of the motor means connected with the rotor, the output shaft and rotor connected by flexible coupling means which includes key means, the pump assembly comprising a pair of intake ports, a pair of exhaust ports, two pairs of radial openings connected by respective axial passageways, a second follower mechanism, piston and resilient means, and the rotor including sealing means disposed axially between the intake ports in order to effect a fluid seal therebetween.

9. The pump assembly in accordance with claim 8, characterized in that the pairs of radial openings are substantially angularly aligned with one another in the rotor.

10. The pump assembly in accordance with claim 8, characterized in that the pairs of radial openings and associated axial passageways are disposed angularly approximately 180° from one another within the rotor.

11. The pump assembly in accordance with claim 8, characterized in that each follower mechanism comprises a ball.

* * * * *